US005704303A

United States Patent [19]

Tseng

[11] Patent Number: 5,704,303

[45] Date of Patent: Jan. 6, 1998

[54] SEWING MACHINE CONTROL MECHANISM

[76] Inventor: Hsien Chang Tseng, 9F., No. 13-4, Sec. 1, Da Ching Street, Taichung, Taiwan

[21] Appl. No.: 807,359

[22] Filed: Feb. 27, 1997

[51] Int. Cl.[6] ..... D05B 1/10

[52] U.S. Cl. ..... 112/200; 112/162; 112/168; 112/166

[58] Field of Search ..... 112/163, 162, 112/159, 165, 166, 167, 168, 197, 199, 200

[56] References Cited

U.S. PATENT DOCUMENTS

| | | | |
|---|---|---|---|
| 2,441,931 | 5/1948 | Clayton | 112/200 |
| 2,758,557 | 8/1956 | Muecke | 112/200 |
| 3,433,191 | 3/1969 | Goebel et al. | 112/166 |
| 3,783,810 | 1/1974 | Marforio | 112/200 X |
| 4,690,080 | 9/1987 | Mikuni et al. | 112/162 |
| 5,269,240 | 12/1993 | Holl et al. | 112/168 X |

*Primary Examiner*—Paul C. Lewis
*Attorney, Agent, or Firm*—Charles E. Baxley, Esq.

[57] ABSTRACT

A sewing machine includes two rods rotatably and slidably supported in the sewing machine and two lower loopers secured on the rods. A spindle is coupled to the rods by an eccentric and coupling members for rotating the rods and the lower loopers. One of the lower loopers may be moved axially together with one rod to which a pawl is rotatably supported. The pawl may be selectively engaging with the other rod for allowing the pawl to selectively moving the other rod axially and for allowing the lower loopers to perform two double chain stitchings.

9 Claims, 6 Drawing Sheets

SEWING MACHINE CONTROL MECHANISM

BACKGROUND OF THE INVENTION

1. Field of the Invention

The present invention relates to a sewing machine, and more particularly to a sewing machine control mechanism.

2. Description of the Prior Art

A typical sewing machine is disclosed in U.S. Pat. No. 4,690,080 to Mikuni et al. and comprises an upper looper and a lower looper for performing three thread overedge stitching and one double chain stitching. Mikuni et al. fails to disclose two lower loopers for performing two double chain stitchings. In addition, the upper looper has not been positioned when the upper looper is not actuated such that the upper looper may be actuated inadvertently by frictional force and such that the upper looper will be damaged.

The present invention has arisen to mitigate and/or obviate the afore-described disadvantages of the conventional sewing machines.

SUMMARY OF THE INVENTION

The primary objective of the present invention is to provide a sewing machine including two lower loopers in which one of the lower loopers may be selectively moved axially for allowing the sewing machine to perform two double chain stitching.

The other objective of the present invention is to provide a sewing machine including two lower loopers in which the other lower looper may be positioned without moving axially while the other looper does not perform double chain stitching.

In accordance with one aspect of the invention, there is provided a sewing machine comprising a first and a second rods rotatably and slidably supported in the sewing machine, the first and the second rods being adapted to be moved longitudinally, a first and a second lower loopers secured on the first and the second rods respectively and rotated in concert with the first and the second rods, means for swinging the first and the second rods and the first and the second lower loopers, means for moving the first rod and the first lower looper axially, and means for selectively moving the second rod and the second lower looper axially.

The swinging means includes a spindle rotatably supported in the sewing machine, two blocks secured on the first and the second rods respectively, an eccentric secured on the spindle and rotated in concert with the spindle, and means for coupling the eccentric to the blocks and for swinging the blocks and the first and the second rods.

The coupling means includes a link pivotally coupling the blocks together, a rotary member rotatably supported in the sewing machine and having a first extension pivotally coupled to the blocks and having a second extension, an actuator having a ring engaged with the eccentric and having an end portion pivotally coupled to the second extension of the rotary member for allowing the eccentric to swing the rotary member and the blocks and the first and the second rods by the actuator.

The means for moving the first rod and the first lower looper axially includes a shaft, two levers secured on the shaft and rotated in concert with the shaft, a moving member rotatably secured on the first rod, means for securing the moving member to the first rod and for allowing the moving member to move axially with the first rod, a first of the levers being secured to the moving member, and means for swinging the shaft and the levers and for allowing the first lever to move the moving member and the first rod axially.

The means for swinging the shaft and the levers includes an eccentric secured on the spindle and rotated in concert with the spindle, an actuator having a ring for engaging with the eccentric and having an end portion pivotally coupled to a second of the levers for allowing the eccentric to swing the levers and the shaft.

The means for selectively moving the second rod and the second lower looper axially includes a stop device secured on the second rod and adapted to move axially with the second rod, a pawl rotatably engaged on the first rod and having a catch for engaging with the stop device, and means for rotating the pawl and for selectively engaging the catch with the stop device B and for allowing the first rod to move the second rod axially by the pawl.

The rotating means includes a pole secured to the pawl, an arm rotatably supported in the sewing machine and having a notch engaged with the pole for allowing the arm to rotate the pawl and for allowing the pawl to move toward and away from the arm.

The arm includes a projection for engaging with the stop device and for positioning the second rod when the catch of the pawl is disengaged from the stop device.

A handle includes a first end secured to the arm and a second end having a knob for rotating the arm and the catch and for actuating the catch of the pawl to engage with the stop device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
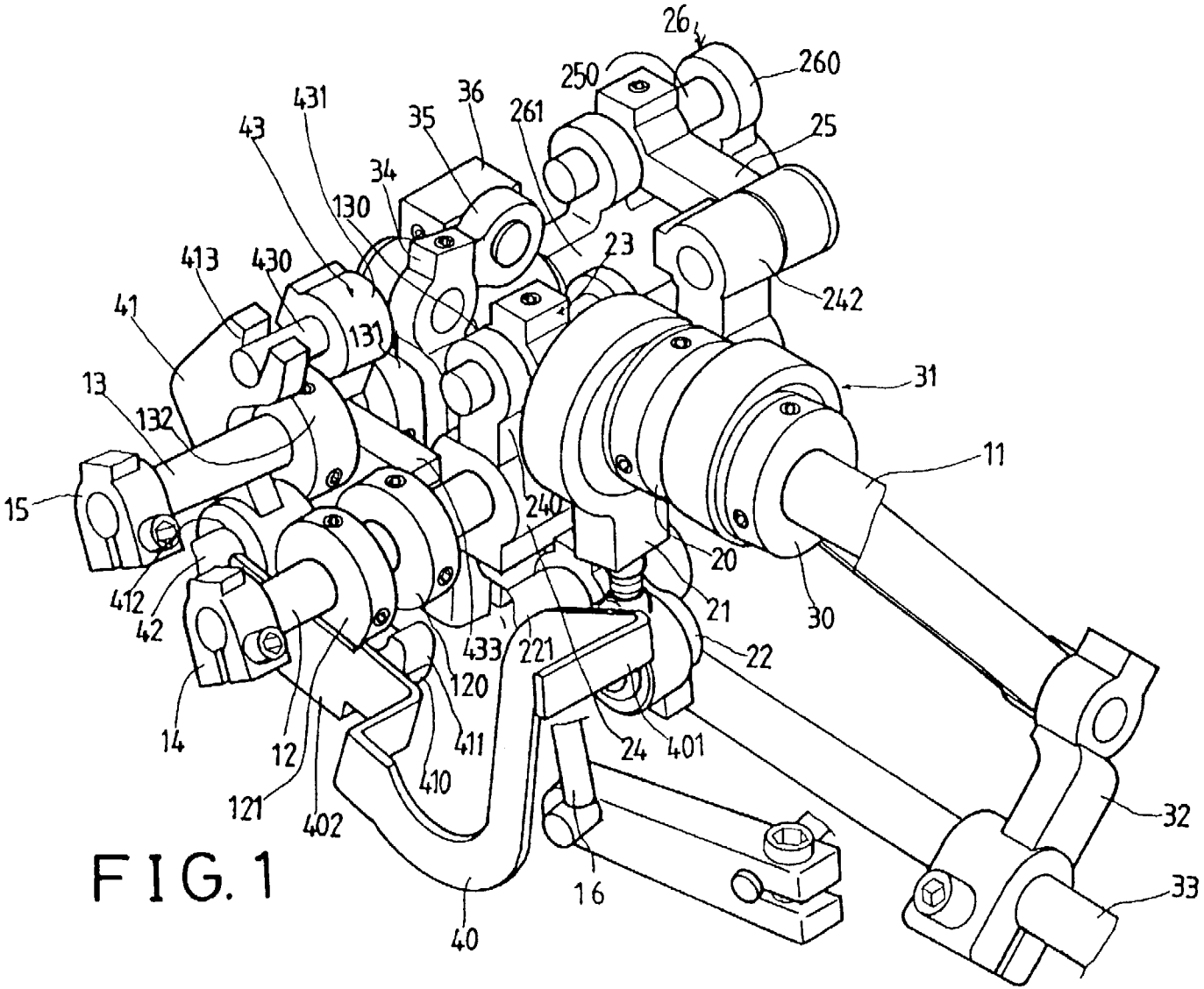
FIG. 1 is a perspective view of a control mechanism of a sewing machine in accordance with the present invention.
Figure 2:
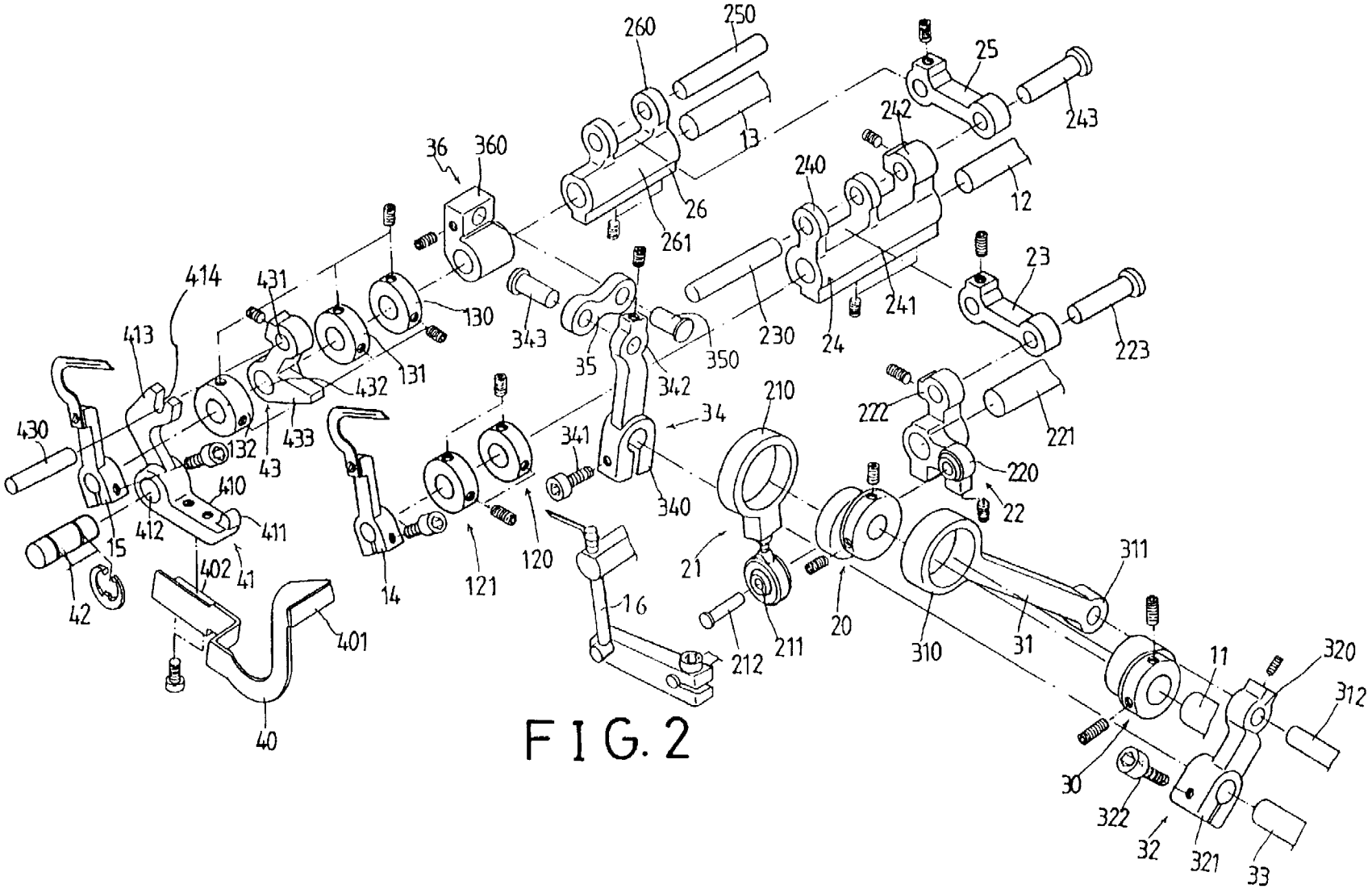
FIG. 2 is an exploded view of the control mechanism.
Figure 3:
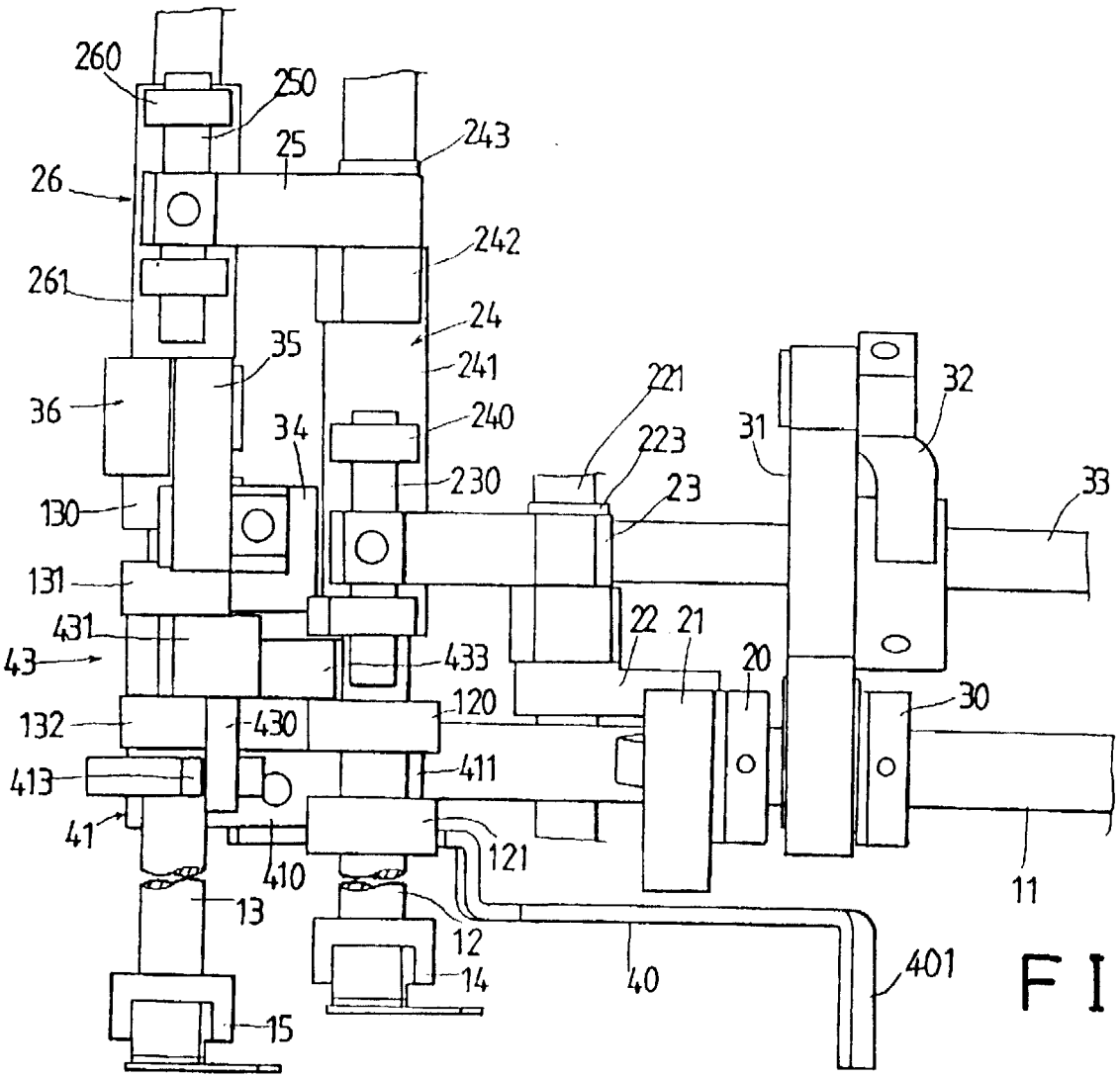
FIGS. 3 and 4 are top view and side view of the control mechanism.
Figure 4:
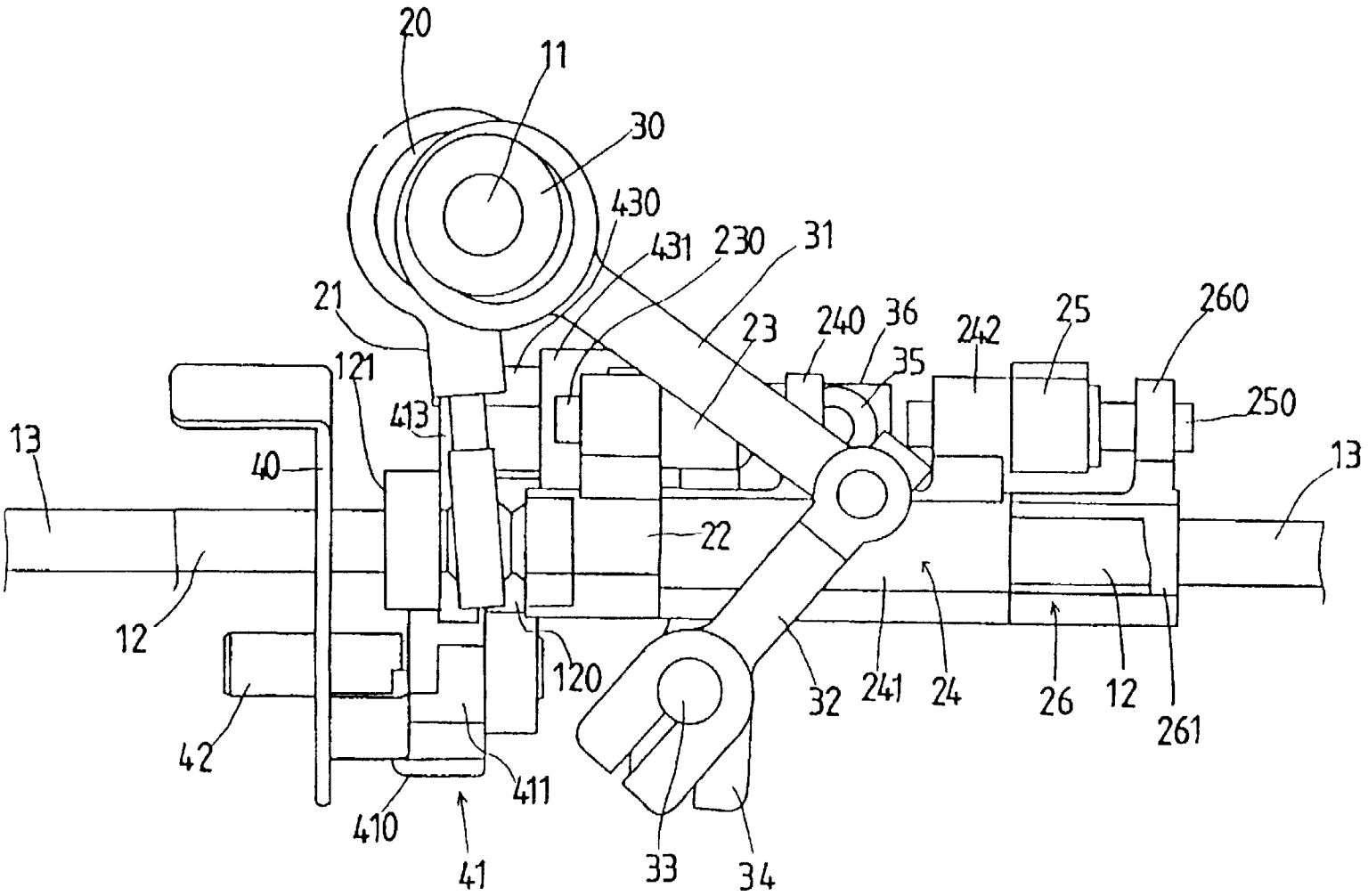

Referring to the drawings, and initially to FIGS. 1 to 4, a sewing machine in accordance with the present invention comprises a spindle 11 and a shaft 33 rotatably supported in parallel in the sewing machine, and two axles 12, 13 rotatably supported in the sewing machine and perpendicular to the spindle 11 and the shaft 33 for securing two lower loopers 14, 15. A conventional upper looper 16 is supported in the sewing machine and movable up and down and is not related to the invention and will not be described in further details.

Two blocks 24, 26 each includes two or more ears 240, 242, 260 and each includes a body 241, 261 secured on the rods 12, 13 and rotated in concert with the rods 12, 13 respectively. A link 25 has two ends pivotally coupled to the blocks 24, 26 by pivot pins 243, 250 for coupling the rotational movement of the two blocks 24, 26 and the rods 12, 13. A rotary member 22 is rotatably supported on an axle 221 secured in the sewing machine and has two extensions 220, 222. A link 23 has two ends pivotally coupled to the block 24 and one extension 222 of the rotary member 22 by pivot pins 230, 223 for allowing the rotary member 22 to rotate the rods 12, 13. Two eccentrics 20, 30 are secured on the spindle 11 for engaging with the rings 210, 310 of two actuators 21, 31 respectively. The actuator 21 has a universal joint 211 pivotally coupled to the other extension 220 of the rotary member 22 by a pivot pin 212 for allowing the spindle 11 to swing the rods 12, 13. Two levers 32, 34 each has one end 321, 340 secured on the shaft 33 by fasteners 322, 341 and rotated in concert with the shaft 33. The lever 32 has the other end 320 pivotally coupled to the other end 311 of the actuator 31 for allowing the spindle 11 to swing the shaft 33 and the levers 32, 34.

A moving member 36 and a pawl 43 each has a hole 432 rotatably engaged on the rod 13 such that the rod 13 may not rotate the moving member 36 and the pawl 43. Three collars 130, 131, 132 are secured on the rod 13 for engaging with and for securing the moving member 36 and the pawl 43 to the rod 13 such that the moving member 36 and the pawl 43 may be moved along the longitudinal axis of the rod 13 by the rod 13 and the collars. A bar 35 has one end secured to the upper end of the lever 34 by a fastener 343 and has the other end secured to the moving member 36 by a fastener 350 such that the moving member 36 and the rod 13 may be moved along the longitudinal axis of the rod 13 by the swinging movement of the lever 34. A pole 430 is secured to a hole 431 of the pawl 43 which includes a catch 433. An arm 41 has a hole 412 rotatably secured on a post 42 and secured in place by clamping rings for allowing the arm 41 to rotate about the post 42 only and for preventing the arm 41 from moving axially along the post 42. The arm 41 has a notch 414 formed in one end 413 of the arm 41 for engaging with the pole 430 and for allowing the arm 41 to rotate the pawl 43 and for allowing the pawl 43 to move toward or away from the arm 41. A handle 40 has one end 402 secured to one leg 410 of the arm 41 for rotating the arm 41 about the post 42 and for rotating the pawl 43. The handle 40 includes a knob 401 formed on the other end and extended outward beyond the control mechanism for allowing the user to rotate the arm 41 by the handle 40. The arm 41 includes a projection 411. A stop device includes two collars 120, 121 secured on the rod 12 and moved axially in concert with the rod 12.

Figure 5:
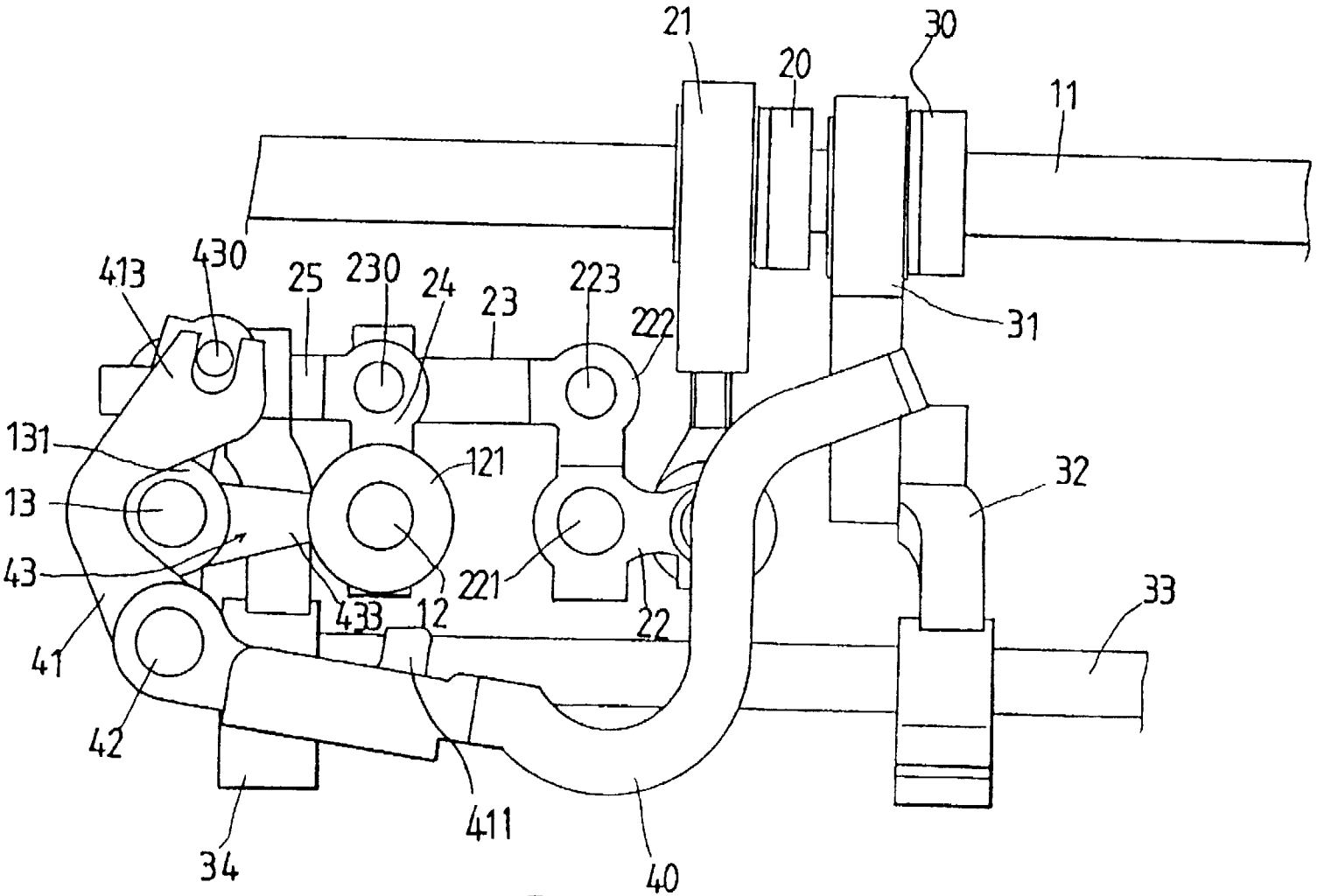
FIGS. 5 and 6 are front views illustrating the operation of the control mechanism of the sewing machine.
Figure 6:
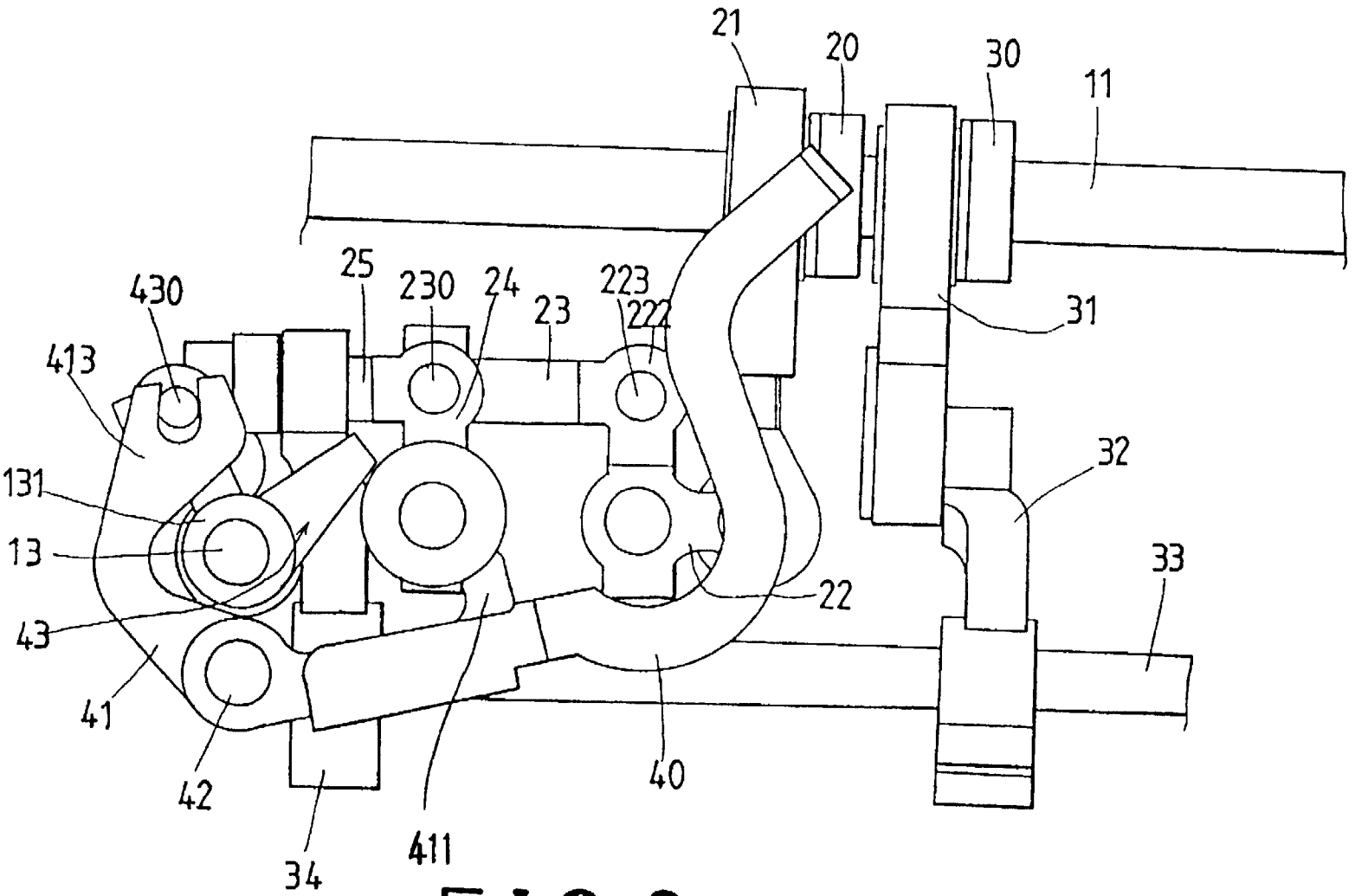

In operation, the catch 433 of the pawl 43 may be rotated to be engaged between the block 24 and the collar 120 (FIGS. 1, 3, 5) by the handle 40 and the arm 41 such that the rod 12 and the lower looper 14 may be moved axially by axial movement of the rod 13 and the pawl 43. At this moment, the projection 411 of the arm 41 is disengaged from the collars 120, 121 (FIGS. 1 and 5). The catch 433 may also be disengaged from the block 24 and the collar 120 (FIG. 6) when the pawl 43 is rotated by the arm 41 and the handle 40, such that the rod 12 may not be moved axially by the axial movement of the rod 13 and the pawl 43. At this moment, the projection 411 of the arm 41 is engaged between the collars 120, 121 for positioning the collars and the rod 12 and for preventing the rod 12 from moving axially. The lower looper 14 may thus be prevented from moving axially inadvertently.

The most important characteristic is that the rod 12 may be selectively moved axially by the pawl 43 and the arm 41 and the handle 40 for allowing the lower looper 14 to move axially. The axial movement of the two lower loopers 14, 15 may be used for performing two double chain stitchings. The lower looper 14 and the upper looper 16 are normally used for performing overedge stitching. The sewing machine may thus be used for performing overedge stitching and one double chain stitching and selectively another double chain stitching. At present, only the overedge stitching and the double chain stitching may be performed by the present sewing machine. None of the sewing machines may be used for selectively performing another double chain stitching except the present invention.

Accordingly, the sewing machine in accordance with the present invention includes one of the lower loopers that may be selectively moved axially for allowing the sewing machine to perform double chain stitching. The other lower looper may be selectively operated to perform another double chain stitching.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sewing machine comprising:

a first and a second rods rotatably and slidably supported in said sewing machine, said first and said second rods being adapted to be moved longitudinally, a first and a second lower loopers secured on said first and said second rods respectively and rotated in concert with said first and said second rods, means for swinging said first and said second rods and said first and said second lower loopers, means for moving said first rod and said first lower looper axially, and means for selectively moving said second rod and said second lower looper axially.

2. A sewing machine according to claim 1, wherein said swinging means includes a spindle rotatably supported in said sewing machine, two blocks secured on said first and said second rods respectively, an eccentric secured on said spindle and rotated in concert with said spindle, and means for coupling said eccentric to said blocks and for swinging said blocks and said first and said second rods.

3. A sewing machine according to claim 2, wherein said coupling means includes a link pivotally coupling said blocks together, a rotary member rotatably supported in said sewing machine and having a first extension pivotally coupled to said blocks and having a second extension, an actuator having a ring engaged with said eccentric and having an end portion pivotally coupled to said second extension of said rotary member for allowing said eccentric to swing said rotary member and said blocks and said first and said second rods by said actuator.

4. A sewing machine according to claim 1, wherein said means for moving said first rod and said first lower looper axially includes a shaft, two levers secured on said shaft and rotated in concert with said shaft, a moving member rotatably secured on said first rod, means for securing said moving member to said first rod and for allowing said moving member to move axially with said first rod, a first of said levers being secured to said moving member, and means for swinging said shaft and said levers and for allowing said first lever to move said moving member and said first rod axially.

5. A sewing machine according to claim 4, wherein said means for swinging said shaft and said levers includes an eccentric secured on said spindle and rotated in concert with said spindle, an actuator having a ring for engaging with said eccentric and having an end portion pivotally coupled to a second of said levers for allowing said eccentric to swing said levers and said shaft.

6. A sewing machine according to claim 1, wherein said means for selectively moving said second rod and said second lower looper axially includes a stop device secured on said second rod and adapted to move axially with said second rod, a pawl rotatably engaged on said first rod and having a catch for engaging with said stop device, and means for rotating said pawl and for selectively engaging said catch with said stop device and for allowing said first rod to move said second rod axially by said pawl.

7. A sewing machine according to claim 6, wherein said rotating means includes a pole secured to said pawl, an arm rotatably supported in said sewing machine and having a notch engaged with said pole for allowing said arm to rotate said pawl and for allowing said pawl to move toward and away from said arm.

8. A sewing machine according to claim 7, wherein said arm includes a projection for engaging with said stop device and for positioning said second rod when said catch of said pawl is disengaged from said stop device.

9. A sewing machine according to claim 7 further comprising a handle including a first end secured to said arm and including a second end having a knob for rotating said arm and said catch and for actuating said catch of said pawl to engage with said stop device.

* * * * *